US009535348B1

(12) United States Patent
Lawton et al.

(10) Patent No.: US 9,535,348 B1
(45) Date of Patent: Jan. 3, 2017

(54) CONTINUOUS COALESCENCE PROCESS FOR SUSTAINABLE TONER

(71) Applicant: Xerox Corporation, Norwalk, CT (US)

(72) Inventors: David J W Lawton, Oakville (CA); Ke Zhou, Oakville (CA); Kimberly D Nosella, Mississauga (CA); Melanie L Davis, Hamilton (CA); Guerino G Sacripante, Oakville (CA); Richard P N Veregin, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/789,973

(22) Filed: Jul. 1, 2015

(51) Int. Cl.
*G03G 9/00* (2006.01)
*G03G 9/08* (2006.01)
*G03G 9/087* (2006.01)

(52) U.S. Cl.
CPC ..... *G03G 9/081* (2013.01); *G03G 9/08755* (2013.01)

(58) Field of Classification Search
CPC ..... G03G 9/081; G03G 9/08755
USPC ..... 430/137.14
See application file for complete search history.

(56) References Cited

U.S. PATENT DOCUMENTS

| | | | | |
|---|---|---|---|---|
| 9,341,968 | B1 * | 5/2016 | Lawton | G03G 9/0808 |
| 2014/0302432 | A1 * | 10/2014 | Chung | G03G 9/08 430/105 |
| 2014/0302436 | A1 * | 10/2014 | Chung | G03G 9/0804 430/113 |
| 2015/0111141 | A1 | 4/2015 | Veregin et al. | |
| 2015/0111146 | A1 | 4/2015 | Zhou et al. | |
| 2015/0111147 | A1 | 4/2015 | Sacripante et al. | |
| 2015/0111151 | A1 | 4/2015 | Lawton et al. | |

* cited by examiner

*Primary Examiner* — Mark A Chapman
(74) *Attorney, Agent, or Firm* — Marylou J. Lavoie, Esq. LLC

(57) ABSTRACT

A continuous coalescence process for preparing a sustainable toner is described which features toner with lowered melt properties and higher toner surface carbon to oxygen (C/O) ratios than previously described sustainable resins coalesced in a batch reactor.

20 Claims, No Drawings

CONTINUOUS COALESCENCE PROCESS FOR SUSTAINABLE TONER

FIELD

The present disclosure relates to continuous coalescence processes for preparing emulsion aggregation (EA) toners comprising bio-based (sustainable) reagents that display lower melt properties without the need for crystalline resin, thereby reducing process cost.

BACKGROUND

The vast majority of polymeric materials are based on the extraction and processing of fossil fuels, a limited resource, and potentially resulting in accumulation of non-degradable materials in the environment. Recently, the USDA proposed that all toners/inks have a biocontent (or sustainable content) of at least 20%. Bio-derived resins are being developed but integration of such reagents into toner and ink remains to be resolved. (The terms, "bio-derived resin," "bio-based resin," and, "sustainable resin," and grammatic forms thereof are used interchangeably herein and are meant to indicate that the resin or polyester resin is derived from or is obtained from materials or reagents that are obtained through natural sources, and is readily biodegradable, in contrast to materials or monomers obtained from petrochemicals or petroleum-based sources.)

Preparation of a sustainable EA toner made in a continuous or semicontinuous process with lower melt properties, higher toner surface carbon-to-oxygen (C/O) ratio and/or lower crystalline polyester resin (CPE) levels would be beneficial.

Those goals were attained in a continuous coalescence process for making toner using bio-based toner reagents.

SUMMARY

The disclosure provides a continuous coalescence process for preparing a sustainable toner having low melt properties, reduced CPE resin content, reduced gel content, higher toner surface carbon-to-oxygen ratio or combinations thereof.

Hence, a continuous coalescence process for making a sustainable toner is disclosed comprising the step of continuously coalescing toner particles comprising a coalescence time of from about 30 seconds to about 10 minutes at a temperature of at least about 80° C. to produce a sustainable toner, wherein said sustainable toner optionally comprises a crystalline polyester (CPE) resin, a gel or both.

DETAILED DESCRIPTION

The disclosure relates to a continuous coalescence process for a bio-based toner with lower melt properties, such as, a lower minimum fix temperature (MFT) and/or higher toner surface C/O ratios than previously described or attainable with batch coalescence. Lower MFT reduces or alleviates need for a CPE resin and thus, lowers cost of the toner. The present disclosure takes advantage of a novel process for making toner comprising continuous coalescence at higher temperatures and with reduced residence time to create uniform populations of unique toner particles in rapid and reproducible fashion. The coalescence conditions impact particle shape, surface composition, intraparticle chemistries between and among components in a toner particle and so on at a higher temperature in an abbreviated period of time.

An incipient or unfinished toner particle is obtained by any known process, such as, a batch process or a continuous process, using, for example, an emulsion aggregation (EA) process. Particles can be made fresh, that is, used without interruption and introduced to the continuous coalescence reactor and reaction of interest, or the particles can be premade and stored, for example, as a slurry of particles that are maintained, for example, under reduced temperature. In the case of a stored preparation, the slurry can be warmed to room temperature (RT) or can be heated to about 40° C. to about 50° C. prior to coalescence. The temperature of the heated, stored particle slurry can approximate that used during freezing of particle growth following aggregation in an EA method.

The particles are moved to a continuous coalescence reactor of interest, which can take any form using any known device so long as the reaction occurs as and in a continuous fluid stream by any means, such as, a conduit, a tubing and so on. Movement of the slurry can be by any means, for example, by gravity, assisted, for example, with an urging device, for example, an impeller, a pump and so on, or by any other means.

The slurry is passed through a first device, section, portion, reactor and the like (hereinafter, "the first portion," or "the first device,") of a coalescence device of interest that comprises a temperature regulating device, such as, a heat exchanger (HEX), wherein the slurry temperature is raised to at least about 80° C., at least about 85° C., at least about 87.5° C., at least about 90° C., or higher, or from about 80° C. to about 98° C., from about 82.5° C. to about 97° C., from about 83° C. to about 95° C., to enable a more rapid coalescence and polish of the particle surface. The pH of the slurry can be from about 7 to about 10, from about 7 to about 9, from about 7 to about 8.5.

The residence time device, section, portion, reactor and the like (hereinafter, "the second portion," or "the second device,") of a reactor of interest comprises a temperature regulating device configured to produce the temperature for rapid coalescing of the toner particles in the slurry.

As known in the art, the residence time of a slurry in any one part of a continuous reactor can depend on slurry viscosity, any pressure used to move the slurry, the bore of any conduit, the length of any conduit and so on. Hence, coalescence can be completed while the slurry is in the first portion of the continuous device of interest comprising a temperature regulating device or in a conduit or reservoir following movement from the first portion of the device of interest comprising a temperature regulating device.

Residence time, that is, the time an aliquot of slurry spends in a continuous reactor at coalescence temperature, can be from about 30 sec to about 10 min, from about 40 sec to about 7 min, from about 50 sec to about 5 min, although times outside of those ranges can be used, depending, on for example, volume capacity of the second portion, volume capacity of conduits exiting the first portion, flow rate, viscosity and so on. A feature of interest to obtain the novel toner particles of interest is the abbreviated time a particle is exposed to the elevated coalescence temperature.

In embodiments, the heated particle slurry optionally flows into and/or through a residence time reactor, or the second portion, wherein the particles are afforded time or more time to coalesce. Generally, the temperature of the residence time reactor is the same as that provided in the first portion or of the slurry exiting the first portion of a device of interest, and temperature maintenance can be provided by a second temperature regulating device or by providing vessels and conduits that are insulated so the temperature of reactants within are maintained while passing therethrough. Residence time in the residence time reactor is determined by the total time needed to complete coalescence of the particles. Coalescence completion is determined as a design choice based on a desired property, such as, circularity, surface C/O ratio and so on.

The coalesced particle slurry then is passed through a portion of the device comprising a second (or third, if a residence time reactor is present) portion, reactor and the like (hereinafter, "the third portion," or, "the third device,") comprising a temperature regulating device, such as, a HEX, which reduces slurry temperature to quench coalescence of the toner particles, which temperature can be about 40° C., RT (about 20° C. to about 25° C.) or at least below the $T_g$ of the resin(s) in the particles. In another embodiment, the coalesced particle slurry is passed directly into a collection vessel that is at a reduced temperature to quench coalescence, for example, the outflow of the continuous reactor, such as, from the first portion or from a second potion, if present, can be transferred to an ice water bath for a rapid quenching of temperature at the conclusion of coalescence.

The rapidity of coalescence and rapid termination of coalescence contribute to higher C/O ratio at the surface of toner particles. The C/O ratio can be about 4 or higher, about 4.1 or higher, about 4.2 or higher, or greater than those ranges.

The amount of CPE in a toner of interest is reduced from levels found in conventional toner, such as, 7 wt %. Hence, a toner of interest comprises a CPE amount of 6 wt % or less, about 5 wt % or less, about 4 wt % or less, about 3 wt % or less, about 2 wt % or less, or lower. In embodiments, a toner comprises no CPE, 0% CPE, is CPE-free and so on where no CPE is included in the toner. Hence, a toner optionally can include a CPE.

A toner of interest comprises a minimum fix temperature at least about 4° C. lower than that of a similar toner except that coalescence occurs in a batch reactor, at least about 5° C. lower, at least about 6° C. lower, or lower than that of conventional toner coalesced in a batch reactor.

A toner of interest comprises reduced levels of gel as compared to the amount found in conventional toner, such as, about 8 wt %. Hence, a toner of interest comprises a gel amount of about 6 wt % or less, about 5 wt % s or less, about 4 wt % or less, about 3 wt % or less, about 2 wt % or less, or a lower amount, including 0%, no gel, gel-free, that is, no gel is used or contained in a toner of interest. Hence, a toner optionally can include a gel.

The continuous process requires fewer devices, provides more uniform results, such as, particles with a lower geometric standard deviation (GSD), reduces production cost and provides higher yield over a defined period of time, generally, a shorter period of time than used with a batch coalescence process. Because smaller quantities of material are processed at a time, quality control is easier to manage. Lot-to-lot variation can be reduced due to control of temperature, uniformity of reaction conditions, shorter processing times and better control of other process parameters. For example, the reaction conditions in a reaction vessel of a batch process often vary in regions of the batch, for example, desired temperature may be attained only along the inner surfaces of the reaction vessel or near a temperature regulating device or element, even with stirring, causing regional microenvironments of different conditions in various areas and regions within a batch reactor, such as, between the material near the walls of a reaction vessel and material at the center of a reaction vessel.

Any continuous apparatus can used to practice the continuous coalescence processes of the present disclosure. A continuous device can comprise one or more temperature controlling or regulating devices to manipulate temperature of a slurry within. Any known temperature controlling or regulating device can be used, such as, a shell-tube heat exchanger, a spiral heat exchanger, a plate-and-frame heat exchanger, a heating coil or element and so on, as known in the art. A holding tank, a pump and a receiving tank also may be used with an apparatus of interest. A holding tank may be the batch reactor in which the particles were made.

Thus, a particle slurry may be provided from a holding tank or from a batch or continuous reactor that passes slurry directly into or to a continuous coalescence reactor of interest. If a particle slurry is stored, the slurry can be treated to approximate conditions of freezing of particle growth following, for example, an EA process. Thus, for example, if a slurry is maintained under reduced temperature, the slurry can be warmed, for example, to RT or to a temperature of from about 40° C. to about 50° C. The increased temperature can facilitate suitable fluid flow.

Coalescence is continuous with a slurry exposed to ramp up temperature to enable coalescence to occur, for example, at a temperature above the $T_g$ of the resin(s) present in the particles in the first portion of a reactor of interest, and then the particles are exposed to a temperature below the $T_g$ of the resin(s) to halt coalescence in the third portion of a reactor of interest.

The particle slurry is drawn from a reactor or from a holding tank and transported by any means to a continuous reactor of interest where the slurry passes through a first temperature regulating device (the first portion) to raise the slurry temperature to, for example, at least about 80° C., at least about 85° C., at least about 87.5° C., at least about 90° C. or higher to enable rapid coalescence.

The heated aggregated particle slurry, having a first elevated temperature to enable coalescence, optionally flows through a residence time reactor (the second portion) which provides a suitable time for a desired level of coalescence to occur. The residence time reactor can comprise a second temperature regulating device. The residence time reactor can be a modified portion of flow path or conduit with an increased inside diameter, where flow rate could decrease, from the first portion or conduit therefrom. The local residence time of the slurry in the residence time reactor may be from about 0.5 min to about 10 min, from about 35 sec to about 9 min, from about 40 sec to about 8 min, from about 50 sec to about 5 min, from about 1 min to about 4 min, although times outside of that range can be used as a design choice.

Depending on flow rate, size or diameter of the flow path, length of the flow path, viscosity of the slurry and so on, coalescence may occur without the need of a residence time reactor or second portion of a device of interest. Thus, the flow path and conduits from the first portion of the device of interest comprising the first temperature regulating device can comprise a second temperature regulating device to ensure the slurry passing therewithin is maintained at an elevated coalescence temperature as transported from the first portion comprising the first temperature controlling device to the third portion for reducing slurry temperature. As described herein, the second portion is optional, for example, depending on the parameters, capacities, urging devices, slurry flow rate, slurry viscosity, residence time and so on of a device of interest, a design choice of a reactor of interest where a focus of the configuration and construction of a device of interest are the temperature of a slurry and the time for coalescence.

After residing in the residence time reactor (the optional second portion of a device of interest) or passing through a flow path or conduit where coalescence is completed, the coalesced particle slurry can be passed through a portion of the continuous device comprising another temperature regulating device, a third device (the third portion). The temperature of the slurry now is decreased, for example, to below the $T_g$ of the resin(s) to quench coalescence. The temperature can be below about 40° C. or at RT, such as, from about 20° C. to about 25° C., or cooler. The quenched coalesced particle slurry then exits the continuous apparatus, for example, into a receiving tank.

Alternatively, the quenched particle slurry at elevated temperature can be discharged from the first or second portion of a continuous coalescence reactor directly into a receiving tank at reduced temperature, such as, a tank comprising iced water or jacketed to be at a temperature below $T_g$ of a resin(s) or near RT.

Each of the three portions of a device of interest can comprise one or more individual devices to ensure a slurry achieves and maintains a desired temperature and resides at a desired temperature for a desired period of time. The conditions are variable as taught herein so long as a particular coalescence temperature is attained and a particular time for coalescence occurs. Those two conditions can be achieved by, for example, considering slurry flow rate, device dimensions, slurry viscosity and so on. Hence, for example, a first portion of a device of interest can comprise one, two or more HEX devices to ramp up or to raise slurry temperature to a coalescence temperature.

The finished coalesced particle slurry comprises coalesced particles having a median diameter ($D_{50}$) ranging from about 3 μm to about 9 μm, from about 3.5 μm to about 8 μm, from about 4 μm to about 7 μm. The coalesced particle slurry may have a $GSD_v$ and/or a $GSD_n$ of from about 1.05 to about 1.35, from about 1.05 to about 1.3, less than 1.35, less than about 1.3, less than about 1.25. GSD and other particle parameters and particle population parameters can be obtained practicing known materials and methods using, for example, commercially available devices, such as, a Beckman Coulter MULTISIZER 3, used as recommended by the manufacturer. The particle diameter at which 84% of a cumulative percentage of particles is attained is defined as volume $D_{84}$ or $D_{v84}$. In embodiments, the populations do not contain particles greater than about 16 μm, greater than about 17 μm, greater than about 18 μm, which is more than about twice the $D_{50}$ of the particles. The amount of fines which are at least about 2 μm less than the $D_{50}$ in size can be less than about 10% of the population, less than about 8%, less than about 6% of the population of particles. The coalesced particles may have a circularity of from about 0.90 to about 0.99, from about 0.91 to about 0.98. Circularity may be measured, for example, using a Flow Particle Image Analyzer, commercially available from Sysmex Corporation.

Although specific terms are used in the following description for the sake of clarity, the terms are intended to refer only to the particular structure of the embodiments selected for illustration and are not intended to define or to limit the scope of the disclosure. In the following description, like numeric designations refer to components of like function.

A resin of interest may be, "bio-based," composed, in whole or in part (e.g., at least about 50%, at least about 60%, at least about 70%, at least about 80%, at least 90% by weight, of biological products or renewable materials (including plant, animal and microbial materials). Generally, a bio-based material is, "biodegradable," that is, substantially or completely biodegradable, by substantially is meant greater than 50%, greater than 60%, greater than 70% or more of the material is degraded from the original molecule to another form or molecule by a biologic or environmental means, such as, action thereon by bacteria, animals, light, heat, plants and so on in a matter of days, matter of weeks, a year or more. A biodegradable material is a sustainable material.

Unless otherwise indicated, all numbers expressing quantities and conditions, and so forth used in the specification and claims are to be understood as being modified in all instances by the term, "about," unless one value is not modified by, "about," and others in the phrase, clause or sentence are modified by, "about." In that case, that particular value is indicated." Thus, if the modifier, "about," is not used, then, equivalent amounts do not apply for that value and only the actual recited value is intended. "About," is meant to indicate a variation of no more than 10% from the stated value. Also used herein is the term, "equivalent," "similar," "essentially," "substantially," "approximating," and, "matching," or grammatic variations thereof, have generally acceptable definitions or at the least, are understood to have the same meaning as, "about." The modifier, "about," should also be considered as disclosing the range defined by the absolute values of the two endpoints. For example, the expression, "from about 2 to about 4," also discloses the range, "from 2 to 4."

By, "two dimension," or grammatic forms thereof, such as, 2-D, is meant to relate to a structure or surface that is substantially without measureable or discernible depth, without use of a mechanical measuring device. Generally, the surface is identified as flat, and emphasizes height and width, and lacks the illusion of depth or thickness. Thus, for example, toner is applied to a surface to form an image or coating and generally, that layer of fused toner is from about 1 μm to about 10 μm in thickness. Nevertheless, that application of toner to a flat surface is considered herein as a two dimensional application. The surface can be a sheet or a paper, for example. This definition is not meant to be a mathematic or scientific definition at the molecular level but one which to the eye of the viewer or observer, there is no illusion of thickness. A thicker layer of toner, such as one which might be identified as providing, "raised lettering," on a surface, is for the purposes herein, included in the definition of 2-D.

By, "three dimension," or grammatic forms thereof, such, as, 3-D, is meant to relate to a structure composed of plural layers or particle depositions of toner that aggregate or assemble to yield a form, a shape, a construct, an object and the like that, for example, need not be applied to a surface or structure, can be autonomous and/or has a thickness or depth. Printing as used herein includes producing 3-D structures. Printing on a surface or structure also is used herein to include forming a 3-D structure by deposition of plural layers of toner. Often, the first layer is printed on a support, surface, substrate, structure and so on. Successive layers of toner are placed thereon and the already deposited (and optionally adhered or solidified) toner layer or layers is considered herein a surface or a substrate.

A polymer can be identified or named herein by the one or more of the constituent monomers used to construct the polymer, even though following polymerization, a monomer is altered and no longer is identical to the original reactant.

Thus, for example, a polyester often is composed of a polyacid monomer or component and a polyalcohol monomer or component. Accordingly, if a trimellitic acid reactant is used to make a polyester polymer, that resulting polyester polymer can be identified herein as a trimellitic polyester. A monomer is a reagent for producing a polymer and thus, is a constituent and integral part of a polymer, contributing to the backbone or linear arrangement of chemical entities covalently bound to form a chain of chemical moieties and that comprise a polymer.

"Population," refers to a collection of particles obtained in a continuous or semicontinuous process of interest. The collection of particles can comprise one or more polymers, and depending on the use, can comprise other components, such as, colorant, wax, surfactant and so on when the resin particles are used to construct toner. The population of resin particles can comprise a shell, surface additives and/or modifications so long as the population is one obtained directly from a continuous coalescence process as taught herein. Population parameters can be obtained as taught herein or as known in the an.

By, "non-classified," is meant that the population of resin particles is not sized, categorized, purified or treated in any way following coalescence and prior to determining the metrics of particle size of the population of particles.

"Fines," or "fine content," refers to particles smaller than those desired. Hence, a substantial fine particle content could provide for a particle size distribution that comprises more than one peak of particles, or a single peak, in a graphical distribution with a curve of increasing particle size to the right, with a shoulder or tail to the left of the mean or average particle size, or the peak is broader with a larger standard deviation, which can be manifest by a curve that is skewed to the left. The $D_{50n}/D_{16n}$ ratio obtained from the particle population distribution can be used as an estimate of the proportion of particles that are below a statistical acceptable size of particles.

"Coarse," or, "coarse content," refers to particles larger than those desired. Hence, a substantial coarse particle content could provide for a particle size distribution that comprises more than one peak of particles, or a single peak, in a graphical presentation with a curve of increasing particle size to the right, with a shoulder or tail to the right of the mean or average particle size, or the peak is broader with a larger standard deviation, which can be manifest by a curve that is skewed to the right. The $D_{48v}/D_{50v}$ ratio obtained from the particle population distribution can be used as an estimate of the proportion of particles that are above a statistical acceptable size of particles.

The, "C/O," ratio of a compound or at the surface of a toner or a carrier is, at the molecular level, the relative amounts of carbon atoms and oxygen atoms of a compound or at the toner or coated carrier surface. In multimolecular structures, the C/O ratio can be ascertained if the molecular formula is known. For molecular complexes, such as, a carrier coating or a toner, the C/O ratio can be approximated by an analysis of components and the relative amounts thereof in the coating or toner. The C/O ratio of the surface of the toner or carrier can be determined, for example, by X-ray photon spectroscopy (XPS) using, for example, devices available from Physical Electronics, MN, Applied Rigaku Technologies, TX, Kratos Analytical, UK and so on. A suitable C/O ratio is at least about 4, at least about 4.1, at least about 4.2, or greater.

Numerical values in the specification and claims of the instant application should be understood to include numerical values which are the same when reduced to the same number of significant figures and numerical values which differ from the stated value by less than the experimental error of conventional measurement technique of the type described in the present application to determine the value.

All ranges disclosed herein are inclusive of the recited endpoint and independently combinable (for example, the range of, "from 2 grams to 10 grams," is inclusive of the endpoints, 2 grams and 10 grams, and all the intermediate values whether explicitly mentioned or not). The endpoints of the ranges and any values disclosed herein are not limited to the precise range or value; the values are imprecise sufficiently to include values approximating those ranges and/or values.

The Toner Particle Slurry

While particles that can be coalesced in the device of interest are not limited by the way manufactured, the following discussion will be directed to particles obtained from an EA process and are those where particle growth or aggregation is terminated or frozen.

The processes of the present disclosure begin with a slurry of incipient toner particles, where the particles are to be coalesced to provide finished toner particles, which travels through at least one temperature regulating device to raise the slurry temperature to the coalescence temperature to enable coalescence of the particles and then through another temperature regulating device to lower the slurry temperature to, for example, RT. The finished toner particles then can be combined with one or more additives, combined with a carrier and so on, as known in the toner and imaging arts.

The particle slurry to be treated in a continuous reactor of interest contains incipient, pretoner, unfinished, incomplete and so on particles in a solvent, such as, water. The particles include one or more resins (i.e. latex) and optionally, an emulsifying agent (i.e. surfactant), one or more colorants, one or more waxes, an aggregating agent, a coagulant and/or one or more additives and so on.

Particles of the instant disclosure comprise any known polymeric materials that can be used to make toner, such as, polystyrenes, polyacrylates, polyesters and so on, as well as combinations thereof and so on suitable for such use. The disclosure herein is exemplified by polyesters.

In embodiments, a resin particle can comprise a crystalline resin and one or more amorphous resins, such as, at least two amorphous resins. The polymer utilized to form the latex may be a polyester resin, including the resins described in U.S. Pat. Nos. 6,593,049 and 6,756,176, the entire disclosure of each of which herein is incorporated by reference in entirety, or a mixture of an amorphous polyester resin and a crystalline polyester resin as described in U.S. Pat. No. 6,830,860, the entire disclosure of which herein is incorporated by reference in entirety.

When at least two amorphous polyester resins are utilized, one of the amorphous polyester resins may be of higher molecular weight (HMW) and the second amorphous polyester resin may be of lower molecular weight (LMW).

An HMW amorphous resin may have, for example, a weight average molecular weight ($M_w$) greater than about 55,000, as determined by gel permeation chromatography (GPC). An HMW polyester resin may have an acid value of from about 8 to about 20 mg KOH/grams. HMW amorphous polyester resins are available from a number of commercial sources and can possess various melting points of, for example, from about 30° C. to about 140° C.

An LMW amorphous polyester resin has, for example, an $M_w$ of 50,000 or less. LMW amorphous polyester resins, available from commercial sources, may have an acid value of from about 8 to about 20 mg KOH/grams. The LMW amorphous resins can possess an onset $T_g$ of, for example, from about 40° C. to about 80° C., as measured by, for example, differential scanning calorimetry (DSC).

Any monomers suitable for preparing a polyester latex, such as, a polyacid and a polyol, may be used to form the toner particles. A catalyst can be used. Preformed polyester polymers can be dissolved in a solvent.

Examples of crystalline resins include polyamides, polyimides, polyolefins, polyethylenes, polybutylenes, polyisobutyrates, ethylene copolymers, polypropylene, mixtures thereof and the like. Specific crystalline resins can comprise poly(ethylene-adipate), polypropylene-adipate), poly(butylene-adipate), poly(pentylene-adipate), poly(hexylene-adipate), poly(octylene-adipate), poly(ethylene-succinate), poly(propylene-succinate), poly(butylene-succinate), poly (pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate) and so on. Examples of polyamides include poly(ethylene-adipamide), poly(propylene-adipamide), poly(butylenes-adipamide), poly(pentylene-adipamide), poly(hexylene-adipamide), poly(octylene-adipamide), poly(ethylene-succinamide) and poly(propylene-sebecamide). Examples of polyimides include poly(ethylene-adipimide), poly(propylene-adipimide), poly(butylene-adipimide), poly(pentylene-adipimide), poly(hexylene-adipimide), poly(octylene-adipimide), poly(ethylene-succinimide), poly(propylene-succinimide) and poly(butylene-succinimide).

The crystalline resin may be present in an amount of from about 5 to about 30% by weight of the toner components (i.e. the slurry less the aqueous phase, that is, the solids content), from about 15 to about 25 wt %. The crystalline resin may possess various melting points of from about 30° C. to about 120° C., from about 50° C. to about 90° C. The crystalline resin may have a number average molecular weight ($M_n$), as measured by gel permeation chromatography (GPC) of from about 1,000 to about 50,000, from about 2,000 to about 25,000, and an $M_w$ of from about 2,000 to about 100,000, from about 3,000 to about 80,000, as determined by GPC. The molecular weight distribution ($M_w/M_n$) of the resin may be from about 2 to about 6, from about 3 to about 5.

Amorphous resins are known, can be made as known in the art or can be purchased commercially.

The latex can comprise biodegradable reagents, such as, those obtained from plants, animals or microbes resulting in resin particles with a lower environmental burden and which are sustainable and biodegradable. Naturally occurring polyacids are known, such as, azelaic acid, citric acid and so on, as are naturally occurring polyols, such as, isosorbide, erythritol, mannitol and so on.

Other suitable monomers that can be used to make the particles of interest comprise a styrene, an acrylate, such as, an alkyl acrylate, such as, methyl acrylate, ethyl acrylate, butyl acrylate, isobutyl acrylate, dodecyl acrylate, n-octyl acrylate, n-butyl acrylate, 2-chloroethyl acrylate, β-carboxyethyl acrylate (β-CEA), phenyl acrylate, methacrylate and so on; a butadiene, an isoprene, an acrylic acid, an acrylonitrile, a styrene acrylate, a styrene butadiene, a styrene methacrylate, and so on, such as, methyl α-chloroacrylate, methyl methacrylate, ethyl methacrylate, butyl methacrylate, butadiene, isoprene, methacrylonitrile, acrylonitrile, vinyl ethers, such as, vinyl methyl ether, vinyl isobutyl ether, vinyl ethyl ether and the like; vinyl esters, such as, vinyl acetate, vinyl propionate, vinyl benzoate and vinyl butyrate; vinyl ketones, such as, vinyl methyl ketone, vinyl hexyl ketone, methyl isopropenyl ketone and the like; vinylidene halides, such as, vinylidene chloride, vinylidene chlorofluoride and the like; N-vinyl indole, N-vinyl pyrrolidone, methacrylate, acrylic acid, methacrylic acid, acrylamide, methacrylamide, vinylpyridine, vinylpyrrolidone, vinyl-N-methylpyridinium chloride, vinyl naphthalene, p-chlorostyrene, vinyl chloride, vinyl bromide, vinyl fluoride, ethylene, propylene, butylene, isobutylene and mixtures thereof. A mixture of monomers can be used to make a copolymer, such as, a block copolymer, an alternating copolymer, a graft copolymer and so on.

The resulting latex may have acid groups. Acid groups include carboxylic acids, carboxylic anhydrides, carboxylic acid salts, combinations thereof and the like. The number of carboxylic acid groups may be controlled by adjusting the starting materials and reaction conditions to obtain a resin that possesses desired characteristics.

Those acid groups may be neutralized by introducing a neutralizing agent, such as, a base solution or a buffer, before or during aggregation. Suitable bases include, but are not limited to, ammonium hydroxide, potassium hydroxide, sodium hydroxide, sodium carbonate, sodium bicarbonate, lithium hydroxide, potassium carbonate, triethylamine, triethanolamine, pyridine and derivatives, diphenylamine and derivatives, poly(ethylene amine) and derivatives, combinations thereof and the like. Those compounds can be dissolved in a suitable solvent, such as, water, alone or in combination to form a buffer. After neutralization, the hydrophilicity, and thus the emulsifiability of the resin, may be improved as compared to a resin that did not undergo such a neutralization process.

An emulsifying agent or surfactant may be present in a dispersion or emulsion, and may include any surfactant suitable for use in forming a resin latex, a colorant, a wax and so on, each of which may be in a dispersion or emulsion with one or more surfactants. Surfactants which may be utilized include anionic, cationic, nonionic surfactants or combinations thereof.

Anionic surfactants include sulfates and sulfonates, sodium dodecyl sulfate (SDS), sodium dodecylbenzene sulfonate, sodium dodecylnaphthalene sulfate, dialkyl benzenealkyl sulfates and sulfonates, acids, such as, abietic acid, combinations thereof and the like. Other suitable anionic surfactants include DOWFAX® 2A1, an alkyldiphenyloxide disulfonate from The Dow Chemical Company, and/or TAYCA POWER BN2060 from Tayca Corporation (Japan), which are branched sodium dodecyl benzene sulfonates.

Examples of nonionic surfactants include, for example, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether and dialkylphenoxy poly(ethyleneoxy) ethanol, for example, available from Rhone-Poulenc as IGEPAL's and ANTAROX 897™. Other examples of suitable nonionic surfactants include a block copolymer of polyethylene oxide and polypropylene oxide, including those commercially available as SYNPERONIC® PR/F and SYNPERONIC® PR/F 108.

Examples of cationic surfactants include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, trimethyl ammonium bromides, halide salts of quarternized polyoxyethylalkylamines, dodecylbenzyl triethyl ammonium chlorides, MIRAPOL® and ALKA- QUAT® available from Alkaril Chemical Company, SANI-SOL® (benzalkonium chloride) available from Kao Chemicals and the like.

A colorant may be present in the toner reagent slurry and includes pigments, dyes, mixtures of pigments and dyes, mixtures of pigments, mixtures of dyes and the like. The colorant may be, for example, carbon black, cyan, yellow, magenta, red, orange, brown, green, blue, violet or mixtures thereof.

The colorant may be present in the toner reagent slurry in an amount of from 0 (clear or colorless) to about 25% by weight of solids (i.e. the solids), in an amount of from about 2 to about 15 w/t % of solids.

A wax also may be present in the toner reagent slurry. Suitable waxes include, for example, submicron wax particles in the size range of from about 50 to about 500 nm, from about 100 to about 400 nm. A wax can have a lower melting point for use in low melt and ultra low melt toner.

The wax may be, for example, a natural vegetable wax, natural animal wax, mineral wax and/or synthetic wax. Examples of natural vegetable waxes include, for example, carnauba wax, candelilla wax, Japan wax and bayberry wax. Examples of natural animal waxes include, for example, beeswax, punic wax, lanolin, lac wax, shellac wax and spermaceti wax. Mineral waxes include, for example, paraffin wax, microcrystalline wax, montan wax, ozokerite wax, ceresin wax, petrolatum wax and petroleum wax. Synthetic waxes of the present disclosure include, for example, Fischer-Tropsch wax, acrylate wax, fatty acid amide wax, silicone wax, polytetratluoroethylene wax, polyethylene wax, polypropylene wax and mixtures thereof.

Examples of polypropylene and polyethylene waxes include those commercially available from Allied Chemical and Baker Petrolite, wax emulsions available from Michelman Inc. and the Daniels Products Company, EPOLENE N-15 commercially available from Eastman Chemical Products, Inc., Viscol 550-P, a low weight average molecular weight polypropylene available from Sanyo Kasei K.K., and similar materials.

In embodiments, the waxes may be functionalized. Examples of groups added to functionalize waxes include amines, amides, imides, esters, quaternary amines, and/or carboxylic acids. In embodiments, the functionalized waxes may be acrylic polymer emulsions, for example, Joncryl 74, 89, 130, 537 and 538, all available from Johnson Diversey, Inc., or chlorinated polypropylenes and polyethylenes commercially available from Allied Chemical, Petrolite Corporation and Johnson Diversey, Inc.

The wax may be present in an amount of from about 0.01 to about 30% by weight of solids, from about 2 to about 20 wt % of solids in the mixture of toner reagents.

An aggregating agent (or coagulant) may be present in the toner reagent mixture. Any aggregating agent capable of causing complexation can be used. Alkali earth metal or transition metal salts may be utilized as aggregating agents. Other examples of aggregating agents include polymetal halides, polymetal sulfosilicates, monovalent, divalent or multivalent salts optionally in combination with cationic surfactants, mixtures thereof, and the like. Inorganic cationic coagulants include, for example, polyaluminum chloride (PAC), polyaluminum sulfo silicate (PASS), aluminum sulfate, zinc sulfate or magnesium sulfate. For example, the slurry may include an anionic surfactant, and the counterionic coagulant may be a polymetal halide or a polymetal sulfo silicate. Coagulant is used in an amount from about 0.01 to about 2%, from about 0.1 to about 1.5% by weight of solids.

A pH control agent, such as, such as, ethylenediamine tetraacetic acid (EDTA), gluconal, hydroxyl-2,2'iminodisuccinic acid (HIDS), dicarboxylmethyl glutamic acid (GLDA), methyl glycidyl diacetic acid (MGDA), hydroxydiethyliminodiacetic acid (HIDA), sodium gluconate, potassium citrate, sodium citrate and so on can assist in controlling pH, sequester cation or both during a later part of the aggregation process.

A charge additive in an amount of from about 0 to about 10 weight %, from about 0.5 to about 7 wt % of solids can be present with the resin particles and other toner reagents. Examples of such charge additives include alkyl pyridinium halides, bisulfates, negative charge enhancing additives, such as, aluminum complexes, and the like, including those disclosed in U.S. Pat. No. 4,298,672, the entire disclosure of which hereby is incorporated by reference in entirety; organic sulfate and sulfonate compositions, including those disclosed in U.S. Pat. No. 4,338,390, the entire disclosure of which hereby is incorporated by reference in entirety; cetyl pyridinium tetrafluoroborates; distearyl dimethyl ammonium methyl sulfate; aluminum salts, such as, BONTRON E84™ or E88™ (Orient Chemical Industries, Ltd.); combinations thereof and the like. Examples of such surface additives include, for example, metal salts, metal salts of fatty acids, colloidal silicas, metal oxides, strontium titanates, mixtures thereof and the like. Surface additives may be present in an amount of from about 0.1 to about 10 weight %, from about 0.5 to about 7 wt % of solids. Other additives include zinc stearate and AEROSIL R972® available from Degussa. The coated silicas of U.S. Pat. Nos. 6,190,815 and 6,004,714, the entire disclosure of each of which hereby is incorporated by reference in entirety, also may be present in an amount of from about 0.05 to about 5%, from about 0.1 to about 2% by weight of solids.

Optionally, a shell resin can be applied to the aggregated particles. Any known resin or resins can be used to form the shell, which can be applied practicing methods known in the art.

There also can be blended with toner particles, external additives including flow aid additives, which additives may be present on or at the surface of toner particles. Examples of additives include metal oxides, such as, titanium oxides, silicon oxides, aluminum oxides, cerium oxides, tin oxides, mixtures thereof and the like; colloidal and amorphous silicas, such as, AEROSIL®, metal salts and metal salts of fatty acids inclusive of zinc stearate and calcium stearate, or of long chain alcohols, such as, UNILIN 700, and mixtures thereof. Suitable additives include those disclosed in U.S. Pat. Nos. 3,590,000, 3,800,588 and 6,214,507, the entire disclosure of each of which hereby is incorporated by reference in entirety.

Each external additive may be present in an amount of from about 0.1% by weight to about 5% by weight of a toner, although the amount of additives can be outside of that range.

The particle slurry can contain from about 10 wt % to about 50 wt % of solids, from about 20 wt % to about 40 wt % of solids in a solvent (such as, water) although solids amounts outside of those ranges can be used, for example, to control viscosity and fluid flow through the continuous reactor.

Continuous Coalescence Process

The incipient toner particles can be made by any process, for example, either by a batch or a continuous process. The particles can be made and stored prior to coalescence, for example, under reduced temperature, or may be used directly after production. The particles are passed through a continuous reactor or microreactor of interest to obtain rapid coalescence at an elevated temperature. As provided above, the unfinished toner particles are exposed to elevated temperature for an abbreviated time to provide the finished toner particles of interest. The toner particles are collected, optionally, can be washed, and then can be treated further to provide toner particles suitable for imaging, for example, comprising one or more surface additives, combined with a carrier and so on.

Particle size measurements, surface area, pore size and other measurements can be obtained practicing known techniques, such as, electroacoustics, capillary flow porometry, gas sorption (BET) and so on, using available devices, such as, from Quantachrome (UK), Malvern Instruments (UK), Micromeritics (Norcross, Ga.) and so on.

The continuous coalescence processes of the present disclosure reduces cycle time, reduces downtime due to apparatus cleaning and increases yield of uniform populations of smaller sized particles of unique conformation and structure. In addition, energy used in heating the slurry can be recovered reducing overall energy consumption and increasing efficiency.

The particles produced by the continuous process of interest are structurally different from particles made by a batch coalescence process, for example, because of the higher temperature, shorter coalescence time and so on. Those conditions result in different structures, for example, at the toner surface, within a toner particle, different structures within the toner and so on.

Toner particles may be formulated into a two component developer composition by mixing with carrier particles. Toner concentration in a developer may be from about 1% to about 25% by weight of the total weight of developer, with the remainder being carrier. However, different toner and carrier percentages may be used to achieve a developer composition with desired characteristics.

Examples of carrier particles for mixing with toner particles include particles that triboelectrically obtain a charge of polarity opposite to that of the toner particles. Illustrative examples of suitable carrier particles include granular zircon, granular silicon, glass, steel, nickel, ferrites, iron ferrites, silicon dioxide, one or more polymers and the like. Other carriers include those disclosed in U.S. Pat. Nos. 3,847,604; 4,937,166; and 4,935,326.

Carrier particles may include a core with a coating thereover, which may be formed from a polymer or a mixture of polymers that are not in close proximity thereto in the triboelectric series, such as, those as taught herein, or as known in the art. Coating may include fluoropolymers, terpolymers of styrene, silanes and the like. A coating may have a weight of, for example, from about 0.1 to about 10% by weight of a carrier.

Various means can be used to apply a polymer to a surface of a carrier core, for example, cascade roll mixing, tumbling, milling, shaking, electrostatic powder cloud spraying, fluidized bed mixing, electrostatic disc processing, electrostatic curtain processing and the like. A mixture of carrier core particles and polymer, for example, as a liquid or as a powder, then may be heated to enable polymer to melt and to fuse to the carrier core. Coated carrier particles then may be cooled and thereafter classified to a desired size.

A toner of interest can find use in any electrophotographic or xerographic imaging device or in a 3-D forming embodiment where structures or devices are created from toner, for example, disposed in the form of a powder, string, sheet and so on where a structure or device is created incrementally, for example, in layers, by repetitious deposition of toner and adhering the deposited toner to an adjacent, previously applied layer of toner, for example, by heating to merge the newly applied layer to the prior applied layer, by applying pressure to the newly applied layer and so on.

The following examples are for purposes of further illustrating the present disclosure. The examples are merely illustrative and are not intended to limit the disclosure to the materials, conditions, or process parameters set forth therein.

EXAMPLES

Synthesis of Bio-Based Resin

To a 1-L Buchi reactor were added a rosin composition comprised primarily of dehydroabietic acid (195.7 g), glycerine carbonate (83.4 g) and tetraethyl ammonium bromide catalyst (1.63 g). The mixture was heated to 170° C. and maintained for 9 hours until the acid value was less than 1 mg KOH/kg. To that mixture then were added neopentyl glycol (63.9 g), dipropylene glycol (47.4 g), tripropylene glycol (28.3 g), terephthalic acid (215.8 g), succinic acid (20.85 g) and FASCAT 4100 catalyst (2.0 g). The mixture was heated from 165° C. to 205° C. over a 5 hour period and maintained overnight at a pH of about 8, followed by increasing the temperature to 215° C. until a resin softening point of between 113° C. and 123° C. was obtained. The resulting bio-based resin was separated.

Toner aggregates derived from combining the bio-resin, 6% carbon black, 9% wax and 6.8% CPE in a 20 gal reactor were obtained following aggregation and freeze yielding 5.57 μm particles (input $D_{50v}$).

Continuous coalescence then was conducted under the various conditions provided in Table 1. The continuous coalescence bench-scale apparatus consisted of a feed tank, two heating heat exchangers, a residence time section and two heat quenching heat exchangers. The, 'bath temp,' is the set-point temperature of the shell on the two heating heat exchangers. The residence time portion or device size was the same for all three experiments, 240 mL, with a flow rate of 240 mL/min that equates to a residence time of 1 minute. Toners then were quenched to approximately RT through the two heat quenching exchangers which were bathed in domestic chilled water (~10° C.). Particles were analyzed with a MULTISIZER and Sysmex FPCA 2100 device.

In the Table, the Bath Temp is the temperature of the water in the jacket of the two heating HEX devices comprising the first portion of the reactor of interest. HEX2 Temp is the temperature of the slurry exiting the second heating HEX of the first portion of the continuous reactor or interest and represents the coalescence temperature of the slurry and particles therein. Input denotes the particles entering the device of interest, that is, entering the first portion of the device, and Output denotes the particles exiting the device of interest, that is, coalesced particles.

TABLE 1

| Run | Bath Temp | HEX2 Temp | Input $GSD_{v84/50}$ | Input $GSD_{n50/16}$ | Output $D_{50v}$ | Output $GSD_{v84/50}$ | Output $GSD_{n50/16}$ |
|---|---|---|---|---|---|---|---|
| 1 | 92 | 89.9 | 1.226 | 1.385 | 5.422 | 1.235 | 1.313 |
| 2 | 92 | 89.5 | 1.226 | 1.385 | 5.508 | 1.266 | 1.343 |
| 3 | 87 | 83.4 | 1.198 | 1.374 | 5.385 | 1.213 | 1.343 |

As a control toner, the frozen aggregates from the 20 gallon batch reactor were coalesced in a Buchi batch reactor at pH 8, at about 90° C. for one hour.

The fusing results are shown in Table 2 below.

TABLE 2

| | Control | Run 1 | Run 2 | Run 3 |
|---|---|---|---|---|
| Cold Offset | 127 | 123 | 123 | 120 |
| MFT | 129 | 124 | 124 | 121 |
| Gloss Mottle | 185 | 185 | 185 | |
| Hot Offset | 190 | 190 | 190 | 165 |

The MFT of the three experimental toners was about 4 to 7 degrees lower than that of the control batch coalesced toner. The lower MFT can enable the reduction of CPE resin content, and thus, lower the cost of the toner while having the advantages of a continuous EA process, such as, reduced processing time.

The present disclosure has been described with reference to exemplary embodiments. Modifications and alterations can occur on reading and understanding the preceding detailed description without departing from the spirit and scope of the subject matter of interest. It is intended that the present disclosure be construed as including all such modifications and alterations insofar as coming within the scope of the appended claims or the equivalents thereof.

All references cited herein are incorporated in entirety by reference in the instant application.

We claim:

1. A continuous coalescence process for making a sustainable toner comprising the step of continuously coalescing toner particles, wherein the toner particles comprise at least one bio-based resin, comprising a coalescence time of from about 30 seconds to about 10 minutes at a temperature of at least about 80° C. to produce sustainable toner, wherein said sustainable toner optionally comprises a crystalline polyester (CPE) resin, a gel or both.

2. The process of claim 1, wherein coalescing comprises coalescing at a temperature of from about 80° C. to about 95° C.

3. The process of claim 1, where coalescing comprises coalescing at a pH from about 7 to about 9.

4. The process of claim 1, wherein coalescing occurs in a single continuous reactor.

5. The process of claim 1, wherein coalescing occurs in plural continuous reactors.

6. The process of claim 1, wherein said toner particles are made in a batch reactor.

7. The process of claim 1, wherein said toner particles are made in a continuous reactor.

8. The process of claim 1, comprising a residence time of from about 40 seconds to about 7 minutes.

9. The process of claim 1, wherein said sustainable toner comprises coalesced particles having a median diameter ($D_{50}$) of from about 3.5 μm to about 8 μm.

10. The process of claim 1, wherein said sustainable toner comprises particles comprising a surface C/O ratio of about 4 or higher.

11. The process of claim 1, wherein the sustainable toner comprises a crystalline polyester resin present in an amount of 4 weight percent or less.

12. The process of claim 1, wherein the sustainable toner is free of crystalline polyester resin.

13. The process of claim 1, wherein said sustainable toner comprises 0% gel.

14. The process of claim 1, comprising prior to coalescing, increasing temperature of said toner particles in a first portion of a reactor.

15. The process of claim 1, optionally comprising a second portion of a reactor for coalescing said toner particles.

16. The process of claim 1, comprising subsequent to coalescing, decreasing temperature of said toner particles in a third portion of a reactor.

17. The process of claim 1, further comprising quenching coalescence in an ice water bath.

18. The process of claim 1, wherein said toner particles comprise a polyester resin.

19. The process of claim 1, wherein said sustainable toner is at least about 50% biodegradable.

20. The process of claim 1, wherein said sustainable toner comprises a wax, a colorant or both.

* * * * *